United States Patent [19]

Danielson, Jr. et al.

[11] 4,012,661

[45] Mar. 15, 1977

[54] THERMAL COMPENSATION FOR COLOR TELEVISION PICTURE TUBE APERTURE MASK

[75] Inventors: Nels Danielson, Jr., Liverpool; William H. Nicklas, N. Syracuse, both of N.Y.

[73] Assignee: General Electric Company, Portsmouth, Va.

[22] Filed: Aug. 22, 1973

[21] Appl. No.: 390,533

[52] U.S. Cl. ..... 313/405

[51] Int. Cl.² ..... H01J 29/07; H01J 29/82

[58] Field of Search ..... 313/85 S, 405, 407

[56] References Cited

UNITED STATES PATENTS

| | | | |
|---|---|---|---|
| 3,452,234 | 6/1969 | Lindeman | 313/85 S |
| 3,617,787 | 11/1971 | Plukker | 313/85 S |
| 3,671,794 | 6/1972 | Nakamura et al. | 313/85 S |
| 3,700,948 | 10/1972 | Palac | 313/85 S |

*Primary Examiner*—Robert Segal

[57] ABSTRACT

In a color television tube, compensation for heating of a three-clip aperture mask assembly due, in large measure, to electron bombardment of the assembly, is improved by tilting the assembly about a horizontal axis as it is moved closer to the screen with increasing temperature. The tilt is achieved by varying the design of the clip attached to one of the horizontal sides of the mask frame, thereby providing the clip with a thermal deflection characteristic different from that exhibited by the clips attached to each of the vertical sides of the frame.

3 Claims, 6 Drawing Figures

THERMAL COMPENSATION FOR COLOR TELEVISION PICTURE TUBE APERTURE MASK

INTRODUCTION

This application relates to color television picture tubes of the aperture mask type, and more particularly to apparatus for compensating such tubes for expansion of the mask produced by temperature changes in the tube.

The frame of an aperture mask for a color television picture tube may be conventionally mounted in the tube using three spring clips, attached to the frame, which slip over internal studs on the faceplate skirt of the tube. During operation of the tube, the aperture mask is heated, largely by electron bombardment. As a result of this heating, the mask expands, causing misregistration between the apertures in the mask and the phosphor regions on the faceplate. To compensate for this misregistration, the clips in some tubes have been made of bimetallic materials which, upon an increase in temperature, rotate about the studs and move the mask closer to the screen.

As a practical matter, thermal compensation of the afore-mentioned type has heretofore been satisfactory for the horizontal component of thermal expansion of the aperture mask. However, compensation for the vertical component of thermal expansion of the mask (which is nonuniform about the horizontal centerline of the mask due to the mask being supported at two points below the horizontal centerline) at best has been satisfactory only for the lower portion of the mask. This is because, in a typical tube, a single clip is attached to the upper horizontal side, or top, of the frame and a separate clip is attached to each vertical side of the frame. The clips at the vertical sides are mounted such that the horizontal component of expansion of the mask causes the clips to lower the mask, and are typically situated below the horizontal centerline of the mask so that the vertical component of expansion of the lower portion of the mask may be at least partially compensated by moving the mask closer to the faceplate.

The vertical component of expansion of the lower portion of the mask at any given distance above the studs at the vertical sides is substantially equal and opposite to expansion of the mask at that same distance below the studs at the vertical sides. However, vertical displacement of the mask above its lower portion exceeds the compensation therefor provided by reaction of the clips at the vertical sides to horizonatal expansion of the mask. This results in a relatively large amount of vertical misalignment between mask apertures and phosphor regions on the upper potions of the mask and faceplate, respectively. Additionally, the lowering of the mask by the clips at the vertical sides, due to horizontal expansion of the mask, tends to introduce vertical misregistration close to the bottom of the mask.

Conventional compensation for misregistration due to mask expansion has been achieved by moving the mask closer to the screen so as to realign the mask apertures within the desired electron beam paths for energizing predetermined phosphor regions. This displacement of the mask toward the screen has theretofore been essentially equal at all points on the mask so that if the mask, for simplicity, is treated as being of planar configuration, it could be described as situated in any of an infinite number of parallel planes, each perpendicular to the longitudinal axis of the tube, depending on temperature of the mask assembly. Such compensation, however, is unsatisfactory due to the above described nonuniform mask expansion in the vertical direction.

Accordingly, one object of this invention is to achieve improved compensation for thermal expansion of an aperture mask in color television picture tube without adversely affecting mechanical support for the mask within the tube.

Another object is to provide more effective compensation for thermal expansion of an aperture mask in a color television picture tube without causing any increased difficulty in attaching the mask to the inside of the tube.

Another object is to achieve improved color purity and white uniformity in a color television picture tube.

Another object is to maintain registration at all times between mask apertures and phosphor regions in a color television picture tube.

Briefly, in accordance with a preferred embodiment of the invention, an aperture mask assembled to a frame is supported within a color television picture tube from studs embedded in the interior surface of the faceplate skirt. First and second bimetallic spring clips are attached to the lower portion of either vertical side of the mask frame, respectively, so that the distal ends of the clips may be pivotally attached to studs on either side of the faceplate skirt respectively, with the studs spaced at equal distances from the horizontal centerline of the mask between the horizontal centerline and the lower horizontal side of the mask. Each of the first and second spring clips exhibits substantially identical displacement of its distal end with any given temperature change so as to provide equal thermal compensation. A third bimetallic spring clip is attached to the upper horizontal side of the mask frame such that the distal end thereof may be pivotally attached to a stud on the faceplate skirt situated along the vertical centerline of the mask. The distal end of the third bemetallic spring clip undergoes greater displacement for any given temperature change than either of the first and second bimetallic spring clips, allowing the upper portion of the mask to move closer to the picture tube screen than the lower portion. In this manner, the effect on registration with the phosphor regions on the faceplate, of unequal thermal expansion about the horizontal centerline of the mask caused by locating the first and second bimetallic spring clips near the lower portion of the mask, is overcome.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
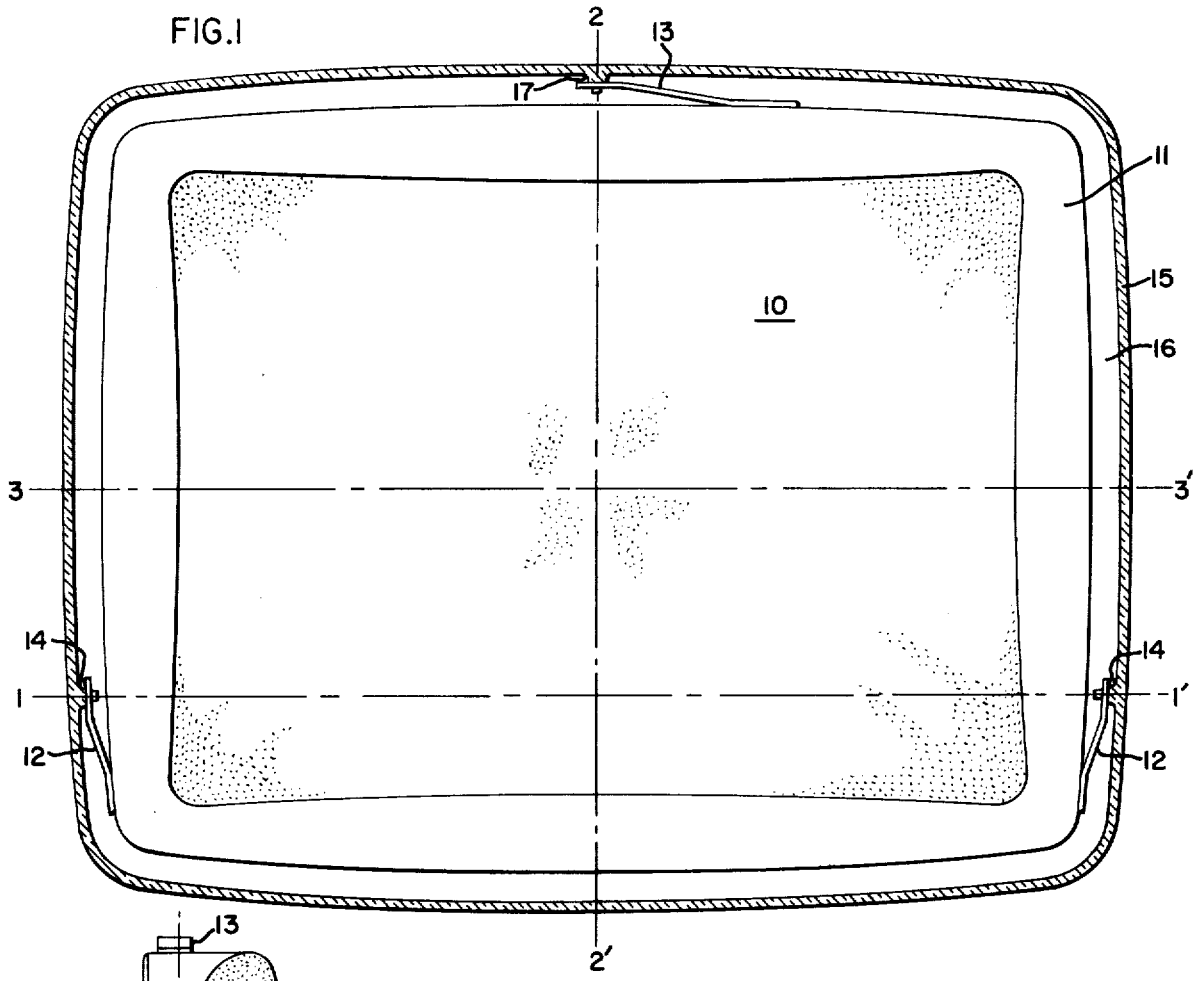
FIG. 1 is a plan view of an aperture mask assembled to a frame and mounted in a picture tube in accordance with the present invention.

In FIG. 1, an aperture mask 10 assembled to a four-sided frame 11 is illustrated. Attached to the vertical or short sides of the mask assembly are a pair of bemetallic spring clips 12, preferably welded to frame 11. A third bimetallic spring clip 13 is attached to one of the horizontal or long sides of the mask assembly, here illustrated as the top, preferably by welding to the frame. Although spring clips 12 and 13 are formed of bimetallic materials, they are each of conventional configuration.

The distal end of each of clips 12 is apertured so as to fit about a metal stud 14 formed on the skirt 15 extending from picture tube faceplate panel 16, while the distal end of clip 13 is apertured to fit about a metal stud 17 formed on faceplate skirt 15. The active region of spring clip 13, or separation between stud 17 and the closest point of attachment of clip 13 to frame 11, is longer or narrower than the active region of either of spring clips 12 (which are identical), or separation between stud 14 and the closest point of attachment of the clip to frame 11.

Studs 14 are situated on a common horizontal axis 1–1′, such that the mask and frame assembly may rotate about this axis in the event clips 12 bend in a plane substantially perpendicular to faceplate panel 16. Similarly, stud 17 is situated on the vertical centerline 2–2′ of the mask and frame assembly, permitting the mask to be rotated about horizontal axis 1–1′ whenever clip 13 bends in a plane substantially perpendicular to faceplate panel 16. Typically, axis 1–1′ is situated between the bottom of mask 10 and horizontal centerline 3–3′. The mask is mounted in the tube such that the longitudinal axis of the tube is directed perpendicular to the mask through the intersection of centerlines 2–2′ and 3–3′.

Figure 2:
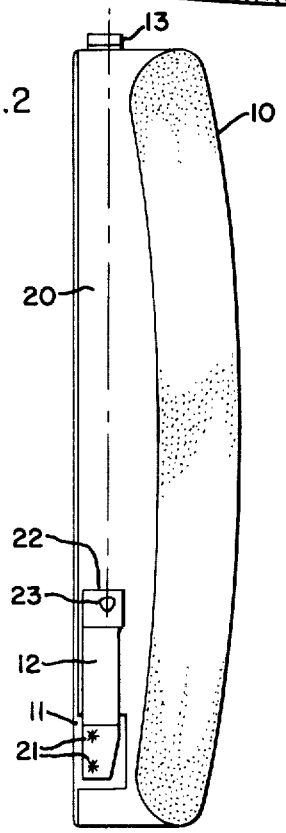
FIG. 2 is a side view of the mask and frame assembly illustrated in FIG. 1.

FIG. 2 is a side view of the mask and frame assembly of FIG. 1, showing the relative locations of bimetallic spring clips 12 and 13 attached thereto. Conveniently, a portion of mask skirt 20 is cut away to permit attachment of spring clips 12 and 13 to mask frame 11, for example, spring clip 12 is fastened to frame 11 with a pair of spot welds 21. Distal end 22 of spring clip 12 contains an aperture 23 therein to fit over a stud on the inside of the faceplate panel skirt, as illustrated in FIG. 1. Those skilled in the art will recognize that the mask and its frame are attached to the faceplate panel skirt in conventional fashion so that mechanical support for the mask is no less secure than for tubes employing conventional thermal compensation and no increased difficulty in attaching the mask to the inside of the tube is experienced.

Figure 3:
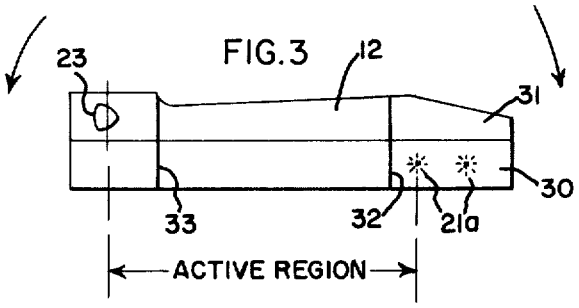
FIG. 3 is a plan view of a typical bemetallic spring clip employed at either vertical side of the mask and frame assembly.
Figure 4:
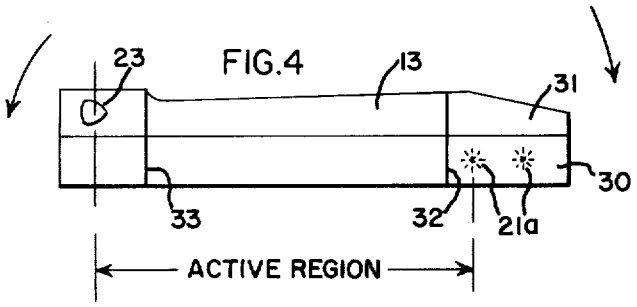
FIG. 4 is a plan view of a typical bimetallic clip employed at a horizontal side of the aperture mask.

FIGS. 3 and 4 are plan views of clips 12 and 13, respectively, showing locations for spot welding to the aperture mask frame. Each clip is formed from a unitary strip of two different metallic or metallic alloy constituents. These constituents exhibit unequal temperature coefficients of expansion and, being intimately joined to each other, as by electron beam welding, respond to temperature changes by mechanically deforming or curling. With constituent 31, such as stainless steel, having a temperature coefficient of expansion greater than that of constituent 30, such as the nickel steel alloy sold under the trademark Invar, clips 12 and 13 tend to deform or deflect in the direction indicated by the arrows as temperature is increased. From a comparison of FIGS. 3 and 4, it is evident that the active region of clip 13 is longer than the active region oc clip 12, the active region being measured from the aperture 23, situated just outside bend 33, to the closest one of weld locations 21*a*, situated just outside bend 32. Having a longer active region that spring clip 12, spring clip 13 exhibits a greater degree of thermally-induced bending than clip 12 for any given temperature change. Those skilled in the art will recognize that the same effect may be obtained if spring clips 12 and 13 have active regions of equal length but with clip 13 having an active region of narrower width.

Figure 5:
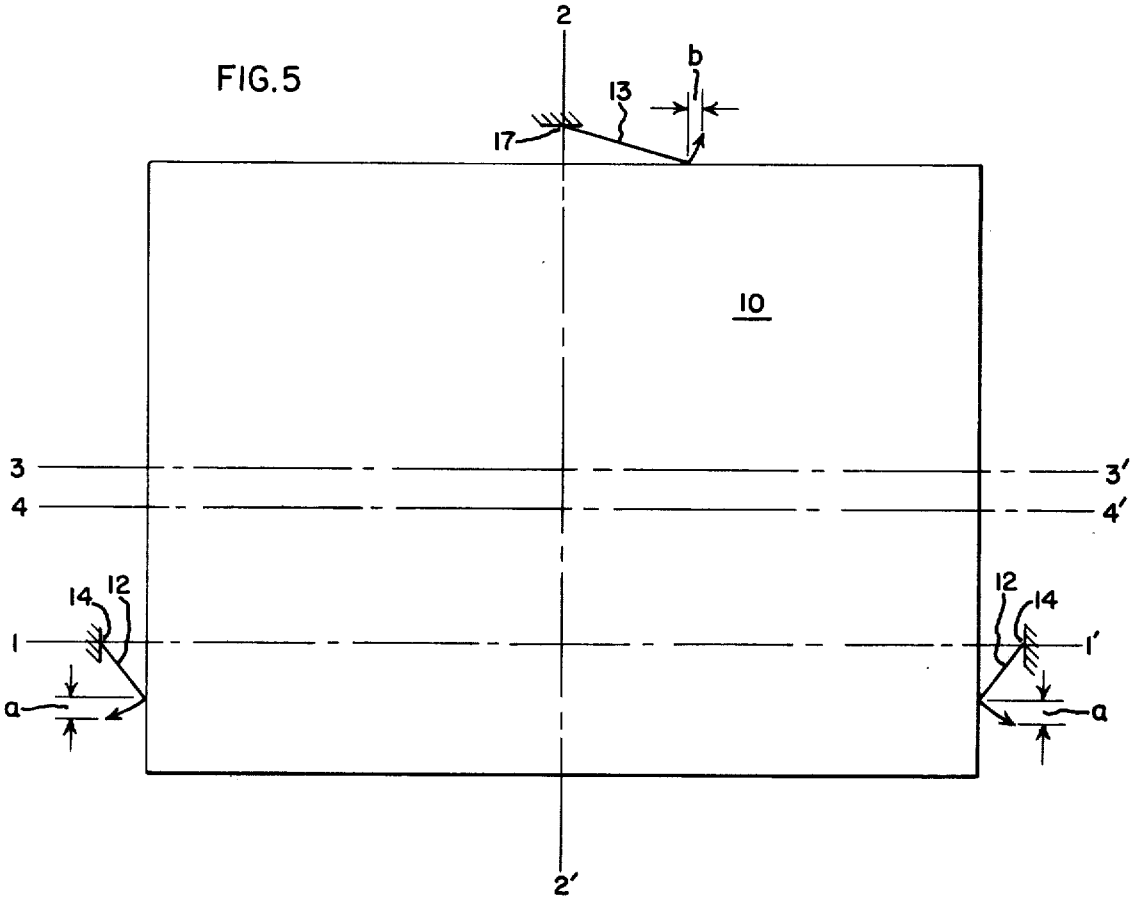
FIG. 5 is a schematic representation of the support points relative to an aperture mask assembly.

FIG. 5 may be used to illustrate geometrically part of the effect of a temperature increase on mask 10 of an assembly employing the instant invention. As temperature increases, mask 10 expands in all directions. As a result of horizontal expansion, clips 12 rotate in the direction indicated by arcuate arrows. Thus, each point on the mask frame where on of clips 12 is fastened to the frame is lowered by an incremental distance *a*. Consequently, the entire mask is lowered by incremental distance *a* as a result of expansion in the horizontal direction.

Expansion if the vertical direction, as temperature increases, occures approximately about axis 1–1′, which passes through fixed points 14. Hence, vertical expansion below axis 1–1′ is in a direction to add to the compensation provided by rotation of clips 12 while vertical expansion above axis 1–1′ is in a direction to subtract from the compensation provided by rotation of clips 12. Along some horizontal axis 4–4′ parallel to horizontal central axis 3–3′, compensation due to rotation of clips 12 about pivot points 14 is equal and opposite to vertical incremental expansion of mask 10 for a given temperature change, so as to exhibit essentially no vertical displacement. When axis 4–4′ is not coincident with axis 3–3′, expansion of mask 10 in the vertical direction would ultimately produce misregistration along axis 3–3′ between the apertures in mask 10 and the phosphor dots on the faceplate of the picture tube. The resulting misregistration errors are not symmetrical about axis 3–3′ so that there is greater misregistration error at the top of the tube than at the bottom.

During vertical expansion, upward movement of the top of aperture mask 10 causes spring clip 13 to rotate about fixed point 17 in the plane of the figure, tending to cause the top of the mask to shift horizontally to the right as temperature increases, and thereby tending to rotate the mask slightly in a clockwise direction. Because of the angular relationship of clip 13, to fixed point 17 the increment *b* by which the top of mask 10 tends to shift to the right is significantly smaller than increment *a*, and can be ignored. It should be noted that both increments *a* and *b* are indicated for the amount of expansion required almost to flatten clips 12 and 13 against the edge of aperture mask 10.

To avoid misregistration between the mask apertures and phosphor dots which would result from mask expansion if spring clips 12 and 13 were allowed to rotate only in the plane of the figure, bimetallic spring clips are employed in the present invention. These bimetallic clips rotate, not only in the plane of the figure, but also in a plane perpendicular to that of the figure. The results of these complex rotations are geometrically illustrated in FIG. 6.

Figure 6:
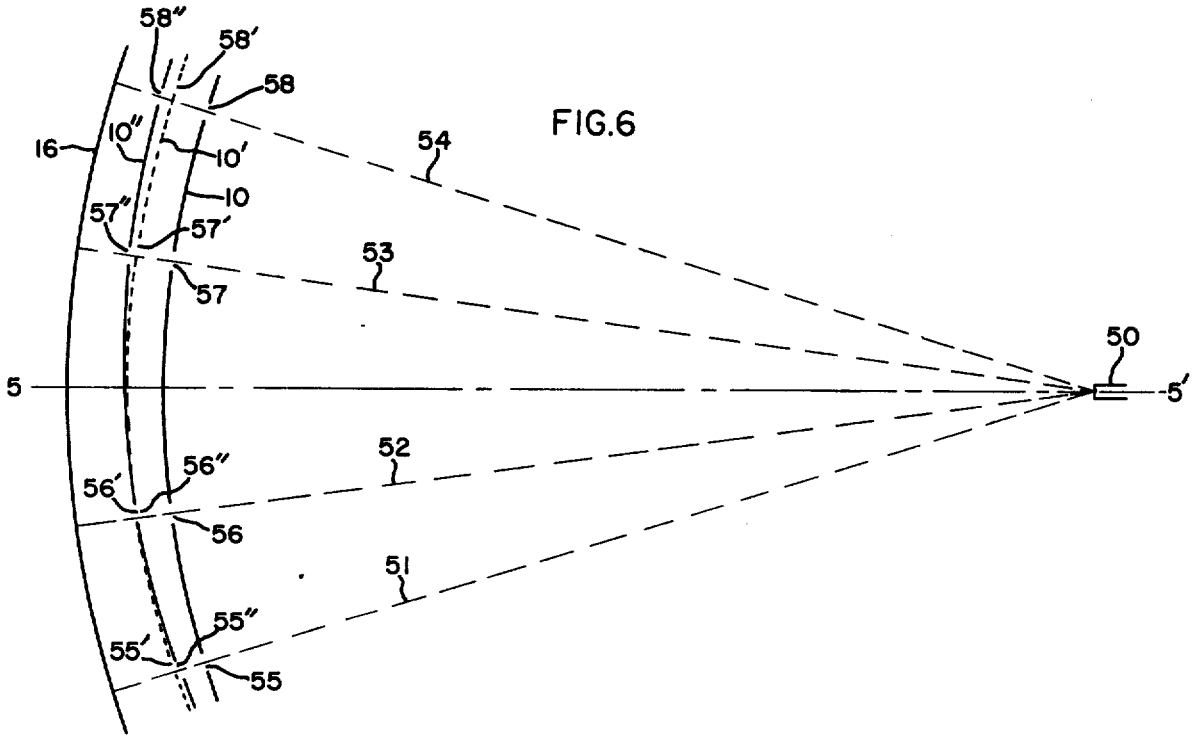
FIG. 6 is a side view schematic representation of electron beam paths in a picture tube relative to the apertures in an aperture mask assembly.

In FIG. 6, an electron gun 50 on longitudinal tube axis 5–5' is shown emitting an electron beam at different times so at to be directed in different directions 51, 52, 53 and 54, toward faceplate 16, of a color television picture tube viewed from the side. For simplicity, only the beam emitted by one electron gun is shown, although most presentday color television picture tubes employ three guns in either an in-line or delta configuration. (In the latter configuration, none of the electron guns would be situated on the longitudinal tube axis, but the invention is applicable in that type of tube also.) Additionally, the electron beams are illustrated as having straight paths although, in actual practice, the paths are bent inasmuch as the electron beams are swept by externally-applied fields. Mask 10 is illustrated in a position assumed when it is cool; that is, when the tube is first turned on. It can be seen that the electron beam in each of positions 51, 52, 53 and 54 passes through mask apertures 55, 56, 57 and 58, respectively, and therefore impinges correctly upon the phosphor coating on the interior side of faceplate 16.

After the tube has been operated for a period of time, the aperture mask expands, increasing the spacing between adjacent ones of apertures 55, 56, 57 and 58. Additionally, however, rotation of bimetallic elements 12 and 13 through a plane perpendicular to the plane of FIG. 5 and as described in conjunction with the description of FIG. 5, causes the mask to move closer to faceplate 16, placing the mask in position 10' and apertures 55, 56, 57 and 58 at locations 55', 56', 57' and 58', respectively. By thus moving the mask closer to the faceplate, it can be seen that the electron beam when in positions 51, 52 and 53 still pass through the apertures at locations 55', 56' and 57' so as to impinge upon the proper phosphor region. However, when in position 54, the electron beam is blocked by the aperture mask and cannot energize the correct phosphor region. Consequently, degradation in color purity or white uniformity of the displayed image occurs near the top of the picture tube faceplate, even though the lower part of the image is displayed with good color purity and white uniformity. Such compensation for color purity and white uniformity errors, albeit only partial, is known in the art.

Aberrations in color of a displayed image can be very displeasing to the viewer. In particular, faces of people displayed on a picture tube are usually presented near the top of the tube. While clothing and even scenery can often be presented with incorrect saturation or even the wrong hue without the viewer being aware of the error, this does not hold true for human faces. Yet, if the viewer attempts to adjust his controls so as to obtain proper color for the faces under conditions such as those occurring when the aperture mask is situated at location 10', the remainder and large majority of the display is presented with degraded color purity or white uniformity.

To obviate the aforementioned conditions, the instant invention provides greater compensation for thermal expansion at the top of the mask than at the sides. Thus, spring clip 13 is so configured as to exhibit a greater degree of thermally-induced bending than spring clip 12 and thereby thrust the upper portion of the mask closer to faceplate 16 than the lower portion of the mask. The mask then assumes position 10'' and apertures 55, 56, 57 and 58 occupy locations 55'', 56'', 57'' and 58''. This permits the electron beam in each of positions 51, 52, 53 and 54 to pass through the apertures at locations 55'', 56'', 57'' and 58'' so as to impinge upon the proper phosphor region in each instance.

Because spring clips 12 and 13 rotate through an arc perpendicular to the plane of FIG. 5, it is evident that the mask is repositioned in the plane of FIG. 5 through incremental distances smaller than *a*. This reduces the misregistration problem which would result from shifting the lower apertures downward by incremental distance a in addition to the increment caused by expansion of the mask, as shown in FIG. 5. Nevertheless, avoidance of shifting the mask through the full incremental distance *a*, in and of itself, does not prevent misregistration occurring at the top of the image displayed on the faceplate of the tube since the prior art correction caused the aperture mask to be thrust forward toward the faceplate by essentially an equal distance over its entire area. By thrusting the aperture mask closer to the faceplate at its top, however, the aforementioned misregistration is greatly reduced, if not altogether eliminated.

The foregoing describes a color television picture tube having improved compensation for thermal expansion of an aperture mask therein without adversely affecting mechanical support for the mask within the tube. Because the invention employes spring clips of well known configuration to be seated on studs embedded in the picture tube faceplate skirt in the manner well known in the art, there is no increase in difficulty in attaching the mask to the inside of the tube. Improved registration in the tube between apertures in the mask and phosphor regions of the faceplate is thereby maintained, along with a concomitant improvement in color purity and white uniformity.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

We claim:

1. In a color television picture tube having a faceplate, a skirt extending from said faceplate, and an aperture mask, said aperture mask being situtated within said tube behind said faceplate and supported by a four-sided frame, apparatus to compensate said tube for expansion of said aperture mask therein due to a temperature rise of said mask so as to maintain registration between apertures in said mask and predetermined regions on said faceplate, said apparatus comprising:

first and second temperature responsive means attaching said frame to the faceplate skirt at each of two points on said skirt situated such that each of said two points is located along a horizontal axis situated below the horizontal centerline of said frame and is coupled to an opposite one of the four sides of said frame below said axis, respectively, each of said temperature responsive means tending, for any given rise in temperature thereof during normal operation of said tube, to thrust the side of said frame to which it is respectively attached toward said faceplate be a predetermined distance; and third temperature responsive means attaching a third one of the four sides of said frame to said faceplate skirt at a third point on said skirt, said third temperature responsive means tending, when experiencing said given rise in temperature, to thrust said third one of the four sides of said frame towards said faceplate by a distance other than said predetermined distance.

2. The apparatus of claim 1 wherein said first and second temperature responsive means are attached to said frame on vertical sides thereof below the horizontal certerline of said frame.

3. The apparatus of claim 2 wherein said third temperature responsive means are attached to said frame on a horizontal side thereof above the horizontal centerline of said frame, said third temperature responsive means tending to thrust said horizontal side toward said faceplate by a distance greater than said predetermined distance.

* * * * *